US006000161A

United States Patent [19]

Aalto

[11] Patent Number: 6,000,161

[45] Date of Patent: Dec. 14, 1999

[54] BREECH MECHANISM FOR BOLT-ACTION FIREARMS

[75] Inventor: Juha Aalto, Riihimaki, Finland

[73] Assignee: Sako Oy, Riihimäki, Finland

[21] Appl. No.: 08/952,236

[22] PCT Filed: May 10, 1996

[86] PCT No.: PCT/FO96/00265

§ 371 Date: Jan. 29, 1998

§ 102(e) Date: Jan. 29, 1998

[87] PCT Pub. No.: WO96/35917

PCT Pub. Date: Nov. 14, 1996

[51] Int. Cl.[6] ..... F41A 3/00

[52] U.S. Cl. ..... 42/16

[58] Field of Search ..... 42/16

[56] References Cited

U.S. PATENT DOCUMENTS

| | | | |
|---|---|---|---|
| 858,715 | 5/1907 | Mondragon | 42/16 |
| 1,161,172 | 11/1915 | Frommer | 42/16 |
| 1,549,235 | 8/1925 | Valero | 42/16 |
| 3,253,362 | 5/1966 | Gitchell | 42/16 |
| 3,368,298 | 2/1968 | Browning | 42/16 |
| 3,416,253 | 12/1968 | Larsson | 42/16 |
| 3,710,492 | 1/1973 | Tirrell | 42/16 |
| 3,979,849 | 9/1976 | Haskins | 42/16 |
| 4,152,855 | 5/1979 | DuBiel et al. | 42/16 |
| 4,547,988 | 10/1985 | Nilsson | 42/16 |

*Primary Examiner*—Charles T. Jordan
*Assistant Examiner*—Denise J. Buckley
*Attorney, Agent, or Firm*—Wolf, Greenfield & Sacks, P.C.

[57] ABSTRACT

The invention relates to a breech mechanism in a bolt-action firearm, consisting of a breech body (2) reciprocating in the receiver (1) and rotatable into locking position, and having on its front portion a locking lug (3, 4, 5) placed in three sectors. The locking lugs (4, 5) in at least two sectors have been formed in a breech mechanism provided with a parallel loading magazine (6) such that there are four guide surfaces (7, 8, 9, 10) limiting breech rotation between the receiver (1) and the breech body (2).

15 Claims, 2 Drawing Sheets

BREECH MECHANISM FOR BOLT-ACTION FIREARMS

This invention relates to a breech mechanism for a bolt-action firearm, the breech mechanism consisting of a breech body reciprocating in the receiver and rotatable into locking position, having in its front portion a locking lug placed in three sectors.

In all bolt-action systems known per se, either complete breech control or parallel loading has been sacrified so far. There are generally three guide surfaces, and it has been found that the breech mechanism tends to swerve when being opened or closed.

The purpose of the invention is to achieve a breech mechanism of a new type for a bolt-action firearm, which is free of the inconveniences mentioned above. The breech mechanism of the invention is characterised in that the locking lugs in at least two sectors have been formed in a breech mechanism provided with a parallel loading magazine such that there are four guide surfaces to limit rotation of the breech mechanism between the receiver and the breech body. Four guide surfaces provide notably better control of the breech mechanism than solutions known per se. The solution of the invention also enables a loose magazine to be filled without the magazine being detached from the firearm, and thus cartridges can be inserted in the magazine from above, as in a conventional magazine.

One embodiment of the invention is characterised in that the guide surfaces are located in the lower locldng lugs of the sector and symmetrically on each side of the breech body.

A second embodiment of the invention is characterised in that the lower locking lugs have longitudinal grooves, which form two lower guide surfaces, and in that the upper surfaces of the lugs form two upper guide surfaces.

Figure 1:
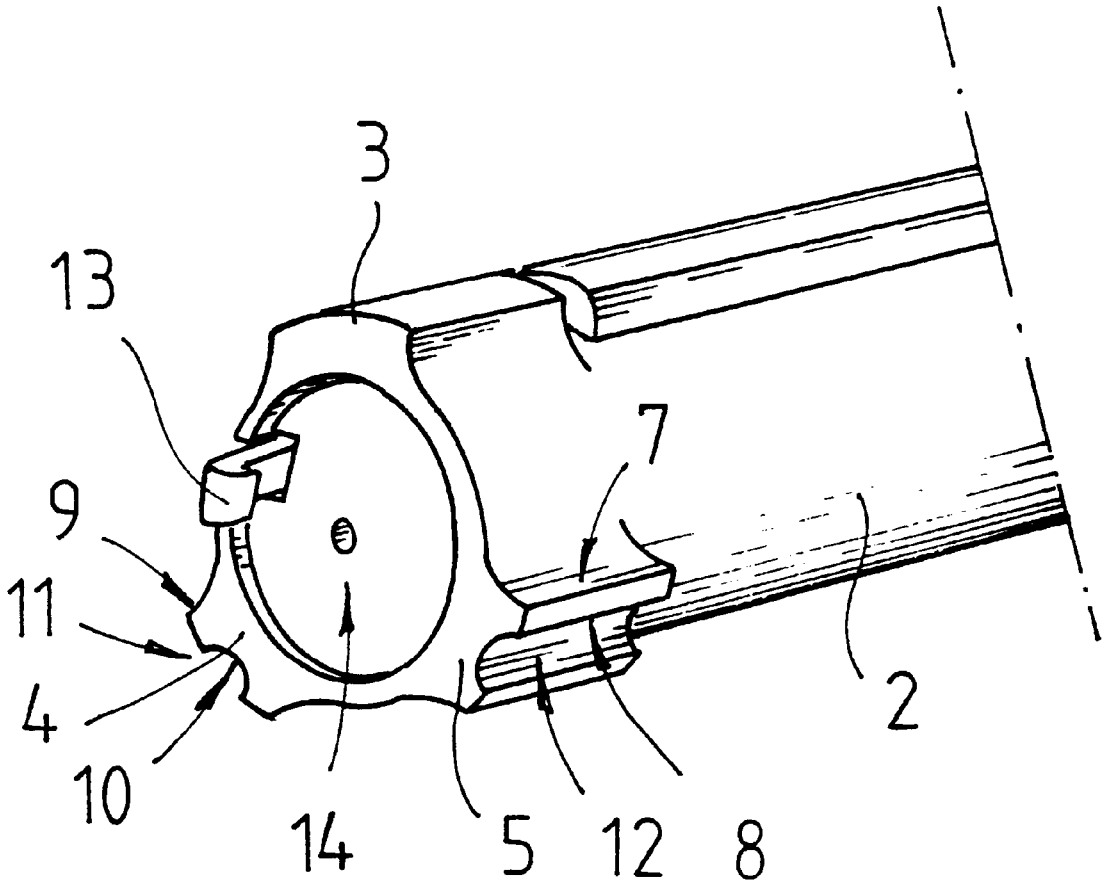
Figure 2:
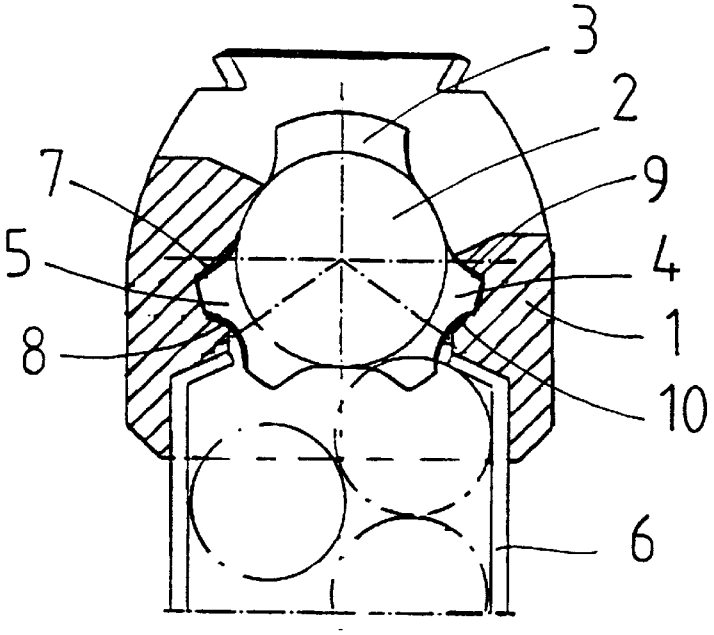
Figure 3:
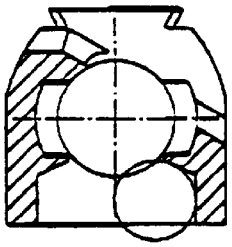
Figure 4:
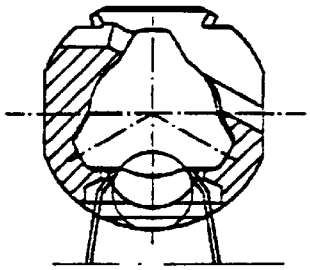
Figure 5:
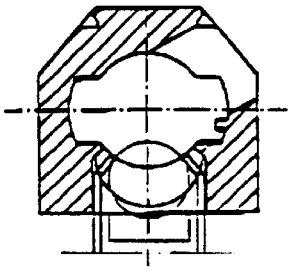
Figure 6:
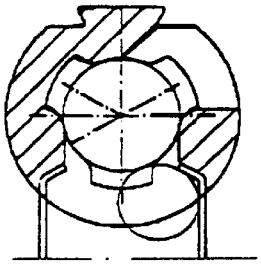

The invention will be described below by means of an example and with reference to the enclosed drawings, in which FIG. 1 is an axonometric view of the front portion of the bolt action FIG. 2 is a cross-section of the breech mechanism of the bolt action and FIGS. 3–6 illustrate bolt-action solutions known per se.

The breech mechanism consists of a breech body 2 reciprocating in the receiver 1 and rotatable into locking position, and having in its front portion a locking lug 3, 4, 5 located in three sectors. The locking lugs in two sectors 4, 5 have been formed in a breech mechanism provided with a parallel loading magazine 6 such that there are four guide surfaces 7, 8, 9, 10 limiting breech rotation between the receiver 1 and the breech body 2. The guide surfaces 7, 8, 9, 10 are located in the lower locking lugs 4, 5 of the sector and symmetrically on each side of the breech body 2. The lower locking lugs 4, 5 have longitudinal grooves 11, 12, which form lower guide surfaces 8, 10 and the upper surfaces of lugs 4, 5 form upper guide surfaces 7, 9. The hook 13 shown in FIG. 1 is a cartridge or shell extractor and the sing pin opening 14 is in the centre.

I claim:

1. A breech mechanism for a bolt-action firearm, comprising a breech body reciprocating in a receiver and rotatable into a locking position, and having on a front portion thereof a locking lug placed in three sectors, wherein the locking lugs in at least two sectors have been formed in a breech mechanism provided with a parallel loading magazine such that there are four guide surfaces to limit breech rotation between the receiver and the breech body, wherein the guide surfaces are located on lower locking lugs of the sector and symmetrically on each side of the breech body, and wherein the lower locking lugs have longitudinal grooves which form two lower guide surfaces and the lower locking lugs have upper surfaces that form two upper guide surfaces.

2. A breech mechanism for a bolt-action firearm including a parallel loading magazine, the breech mechanism comprising:

a receiver;

a breech body that is constructed and arranged to reciprocate in the receiver and to be rotatable to a locking position, the breech body including a front portion having an outer periphery; and a plurality of locking lugs disposed on the outer periphery of the front portion of the breech body, at least two of the locking lugs including a pair of guide surfaces so that the breech mechanism includes four guide surfaces that cooperate with the receiver to limit rotation between the receiver and the breech body when the locking lugs overlay the parallel loading magazine.

3. The breech mechanism recited in claim 2, wherein the at least two locking lugs are symmetrically disposed on a lower portion of the breech body adjacent the parallel loading magazine.

4. The breech mechanism recited in claim 3, wherein each pair of guide surfaces includes an upper guide surface and a lower guide surface, each of the at least two locking guides having a longitudinal groove that forms the lower guide surface.

5. The breech mechanism recited in claim 4, further comprising a cartridge extractor supported on the front portion of the breech body.

6. The breech mechanism recited in claim 5, wherein the cartridge extractor includes a hook.

7. The breech mechanism recited in claim 2, wherein each of the at least two locking guides has a longitudinal groove that forms one of the guide surfaces.

8. The breech mechanism recited in claim 2, wherein the plurality of locking lugs includes three locking lugs spaced substantially equal about the outer periphery of the front portion.

9. In a bolt-action firearm including a breech mechanism and a parallel loading magazine to supply cartridges to the breech mechanism, the breech mechanism comprising:

a receiver;

a breech body that is constructed and arranged to reciprocate in the receiver and to be rotatable to a locking position, the breech body including a front portion having an outer periphery; and three locking lugs disposed on the outer periphery of the front portion of the breech body, at least two of the locking lugs including a pair of guide surfaces so that the breech mechanism includes four guide surfaces that cooperate with the receiver to limit rotation between the receiver and the breech body when the locking lugs overlay the parallel loading magazine.

10. The breech mechanism recited in claim 9, wherein the at least two locking lugs are symmetrically disposed on a lower portion of the breech body adjacent the parallel loading magazine.

11. The breech mechanism recited in claim 10, wherein each pair of guide surfaces includes an upper guide surface and a lower guide surface, each of the at least two locking guides having a longitudinal groove that forms the lower guide surface.

12. The breech mechanism recited in claim 11, further comprising a cartridge extractor supported on the front portion of the breech body.

13. The breech mechanism recited in claim 12, wherein the cartridge extractor includes a hook.

14. The breech mechanism recited in claim 9, wherein each of the at least two locking guides has a longitudinal groove that forms one of the guide surfaces.

15. The breech mechanism recited in claim 9, wherein the three locking lugs are circumferentially spaced substantially equal about the outer periphery of the front portion.

* * * * *